US005860311A

United States Patent [19]

Donini et al.

[11] Patent Number: 5,860,311

[45] Date of Patent: Jan. 19, 1999

[54] METHOD TO GUIDE THE STRIP BETWEEN THE STANDS IN A ROLLING MILL FINISHING TRAIN AND RELATIVE DEVICE

[75] Inventors: Estore Donini, Vimercate; Fausto Drigani, Zugliano-Pozzuolo Del Friuli, both of Italy

[73] Assignee: Danieli & C. Officine Meccaniche SpA, Buttrio, Italy

[21] Appl. No.: 838,949

[22] Filed: Apr. 23, 1997

[30] Foreign Application Priority Data

Apr. 23, 1996 [IT] Italy ..... UD96A0055

[51] Int. Cl.[6] ..... B21B 39/20; B21B 41/00

[52] U.S. Cl. ..... 72/250; 72/251; 72/227

[58] Field of Search ..... 72/8.6, 11.4, 11.5, 72/12.3, 203, 205, 234, 250, 251, 252, 365.2, 227

[56] References Cited

U.S. PATENT DOCUMENTS

| | | | |
|---|---|---|---|
| 1,956,636 | 5/1934 | Biggert, Jr. . | |
| 2,469,169 | 3/1949 | Markle . | |
| 3,727,446 | 4/1973 | Shumaker | 72/250 |

FOREIGN PATENT DOCUMENTS

| | | |
|---|---|---|
| 0745440 | 12/1996 | European Pat. Off. . |
| 1087143 | 2/1955 | France . |
| 1527635 | 1/1970 | Germany . |

OTHER PUBLICATIONS

Patent Abstracts of Japan, vol. 011, No. 111 (M–578) 8 Apr. 1987 & JP–A–61–255714 (Ishikawajima Harima) 13 Nov. 1986.

Patent Abstracts of Japan vol. 15, No. 249 (M–1128) 25 Jun. 1991 & JP–A–03 081010 (NNK Corp.) 5 Apr. 1991—Abstract.

Patent Abstracts of Japan No. 018, No. 264 (P–1740) 19 May 1994 & JPA–06 042950 (Kawasaki Steel) Feb., 18, 1994—Abstract.

Patent Abstracts of Japan vol. 006, No. 224 (M–170) 9 Nov. 1982 & JP–A–57 127517 (Hitachi) 7 Aug. 1982 Abstract.

*Primary Examiner*—Joseph J. Hail, III
*Assistant Examiner*—Rodney Butler
*Attorney, Agent, or Firm*—Antonelli, Terry, Stout & Kraus, LLP

[57] ABSTRACT

Method and device to guide the strip between the stands in a rolling mill finishing train to roll thin strips of a final thickness in the order of 1.2 mm and less, the inter-stand device including at least a guide device arranged at the outlet of the upstream stand (11*a*), a looper unit (15) comprising at least a looper roller (20) and a guide device arranged at the inlet to the downstream stand (11*b*), the looper roller (20) having at least a lowered position at the step before the leading end of the strip enters and a plurality of raised positions, while the strip is passing through, to form the desired loop, the looper roller (20), at least when it is in the lowered position before the strip enters, being made to rotate at a tangential speed at least equal to the speed at which the strip is fed between the stands. The looper unit (15) comprises an empowered drive (21) associated with the looper roller (20) at least when the looper roller (20) is in its lowered position, the drive (21) being structured to make the looper roller (20) rotate, before the strip enters, at a tangential speed at least equal to the speed at which the strip is fed between the stands.

15 Claims, 3 Drawing Sheets

METHOD TO GUIDE THE STRIP BETWEEN THE STANDS IN A ROLLING MILL FINISHING TRAIN AND RELATIVE DEVICE

BACKGROUND OF THE INVENTION

This invention concerns a method to guide the strip between the stands in a rolling mill finishing train and the relative device to be installed between the stands.

The invention is applied in hot rolling mills, in particular but not exclusively in finishing trains for rolling thin strips.

A conventional inter-stand device in a finishing train for strip usually comprises a guide device placed at the outlet of the stand upstream, a looper unit and a guide device placed at the inlet to the stand downstream.

The inter-stand device, and particularly the guide devices, have the function of transporting the leading end of the strip from one stand to the next stand, preventing the strip from hitting the inlet as it enters and the consequent accordion-like "buckling".

The inter-stand device is also intended to prevent the trailing end of the strip, when it comes out of the upstream stand, going to damage the working rolls of the stand with vertical, "tail-wagging" movements.

The looper unit, apart from cooperating with the guide devices in the above-mentioned functions, is also intended to generate and measure a desired loop on the strip during the rolling process, making it possible to adjust the speed of the rolls in the stand in order to maintain a flow of material as steady as possible between the upstream stand and the downstream stand.

The guide devices can be adjusted in height in order to align, with a certain tolerance, the pass-line of the guides with the tangent wire steel of the respective lower working rolls of the upstream and downstream stands.

This alignment allows the inter-stand device to be adapted to the variations in size of the working rolls and back-up rolls of the rolling stands.

The guide devices and the looper unit are moreover associated with moving units which make it possible to change the working and back-up rolls.

In devices known to the state of the art, the looper roller is an idler roller and is made to rotate by the strip itself.

When the strip enters the stand, in the state of the art, the looper roller is kept in a lowered position so as not to interfere with the pass-line of the guide devices.

Once the leading end of the strip has entered the downstream stand, the looper roller is raised and brought into contact with the strip which starts it rotating.

The lifting and lowering movement of the looper roller is normally generated by an electric motor or by a hydraulic roll; the looper roller itself is controlled, if necessary with a feedback circuit, to maintain the drawing action between stands at substantially constant values.

This function makes it possible to prevent the formation of shrinkages and variations in the width of the strip being rolled which derive from a non-uniform drawing action.

In the case of thin strip being rolled, with a thickness of less than 1.2 mm, the configuration of the inter-stand device as described above involves a plurality of disadvantages.

If the final product is to have a thickness of 1.2 mm, the inter-stand device upstream of the last stand in the finishing train operates on a thickness of about 1.5 mm.

Until this limit value, the bending rigidity of the strip is such as to allow it to pass through the inter-stand device without too much difficulty even at speeds of about 9÷10 meters per second.

For thicknesses of less than 1.5 mm, because of the friction generated by the strip slipping on the carrying surfaces of the guides and the looper roller, and because of the reduced bending rigidity, which varies in inverse proportion to the cubic power of the thickness, the transfer of the leading end of the strip is difficult, there are dangers of "buckling" and overlapping of the strip inside the inter-stand device.

Moreover, there is also the problem of the impact between the strip passing through and the looper roller, which is stationary at first; this impact can cause slipping which can damage the surface of the strip.

JP-A-3-81010 discloses a looper equipped with a roller which, when the strip enters the device, is rotating at a greater speed than that of the strip and, when the trailing end is passing through, is made to rotate in the inverse direction.

These differences in speed cause the looper to slip on the strip, damaging both the strip and itself, and this solution is therefore unacceptable.

JP-A-61255714 discloses a pre-heating system of the strip between two stands.

This prior art document includes two rollers (11, 26), which are not powered; they support the strip and have a function of strip tension detection.

Therefore, JP'714 deals with problems which are different from those addressed by this invention (see also the arm 18), as it deals with the need to provide a correct transit line, and to allow the strip to pass inside the furnace.

Nor are the embodiments therein disclosed suitable to be applied to this invention.

SUMMARY OF THE INVENTION

The present applicants have designed, tested and embodied this invention to overcome the above-mentioned shortcomings of the state of the art and to achieve further advantages.

The purpose of this invention is to provide a method to guide strip between the stands, and the relative device, which can ensure the efficient carrying of the strip even when thin strips, less than 1.2 mm thick, are rolled.

The inter-stand device according to the invention has a system to align the guides to the pass-line of the upstream stand with the downstream stand.

According to the invention, this alignment is achieved by means of independent controls, for example, two jack screws, which act on the common frame of the guide devices and the looper unit, allowing the guides to be aligned with the wire steel of the lower working rolls of the upstream and downstream stands.

According to the invention, the ideal pass-line is calculated according to the real configuration of the stand, for example the values of the thicknesses and diameters of the working and back-up rolls, and the jack screws are used to align the guides to the ideal pass-line, correcting any discrepancies in feedback.

In the inter-stand device according to the invention, the planes of the guides and the plane of the looper are composed of strips, placed at a distance from each other and made of an anti-friction material such as cast iron, in such a way as to reduce the friction which tends to make the strip rise up as it passes through.

According to the invention, apart from the usual moving means which regulate the position of the looper roller with respect to the pass-line of the strip to be rolled, the looper roller is also associated with drive means to bring it into rotation.

The drive means may be disposed on the roller itself or, according to a variant, outside the roller and associated therewith by means of the appropriate transmission means.

According to the invention, before the leading end of the strip enters, the looper roller is made to rotate at a tangential speed at least equal to the transit speed of the strip.

According to a variant, before the leading end of the strip enters, the looper roller is made to rotate at a speed greater than that of the strip by a value of between 5% and 20%.

The advantage of making the looper roller rotate when it is in the lowered position before the leading end of the strip enters is that it does not modify the inertia of the roller or the overall inertia of the looper system, which gives a more precise control of the the inter-stand drawing action.

Moreover, the friction deriving from the impact between the strip and the looper roller is eliminated.

The looper roller also assists the feed of the strip by exerting tangential thrusts on the strip in a direction appropriate to the direction of transit.

According to the invention, when the strip comes into contact with the rotating looper roller, the looper roller is made to idle.

According to a variant, when the strip comes into contact with the looper roller, the looper roller is made to rotate at a speed equal to that of the strip, if it is not already doing so.

According to another variant, when the strip comes into contact with the looper roller, the looper roller is maintained at a speed which is slightly higher than that of the strip.

According to a variant of the invention, when the strip enters the device, the rotating looper roller is positioned at a height slightly above the ideal pass-line so as to create a desired and controlled loop.

According to a variant, the guide at the outlet of the upstream stand and/or the guide at the inlet of the downstream stand comprise driven drawing means to reduce the friction deriving from the impact of the strip in transit.

According to a first embodiment of the invention, the guides are composed of driven metallic strips.

According to another embodiment, the guides are composed of strips from whose carrying surface driven rollers protrude.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
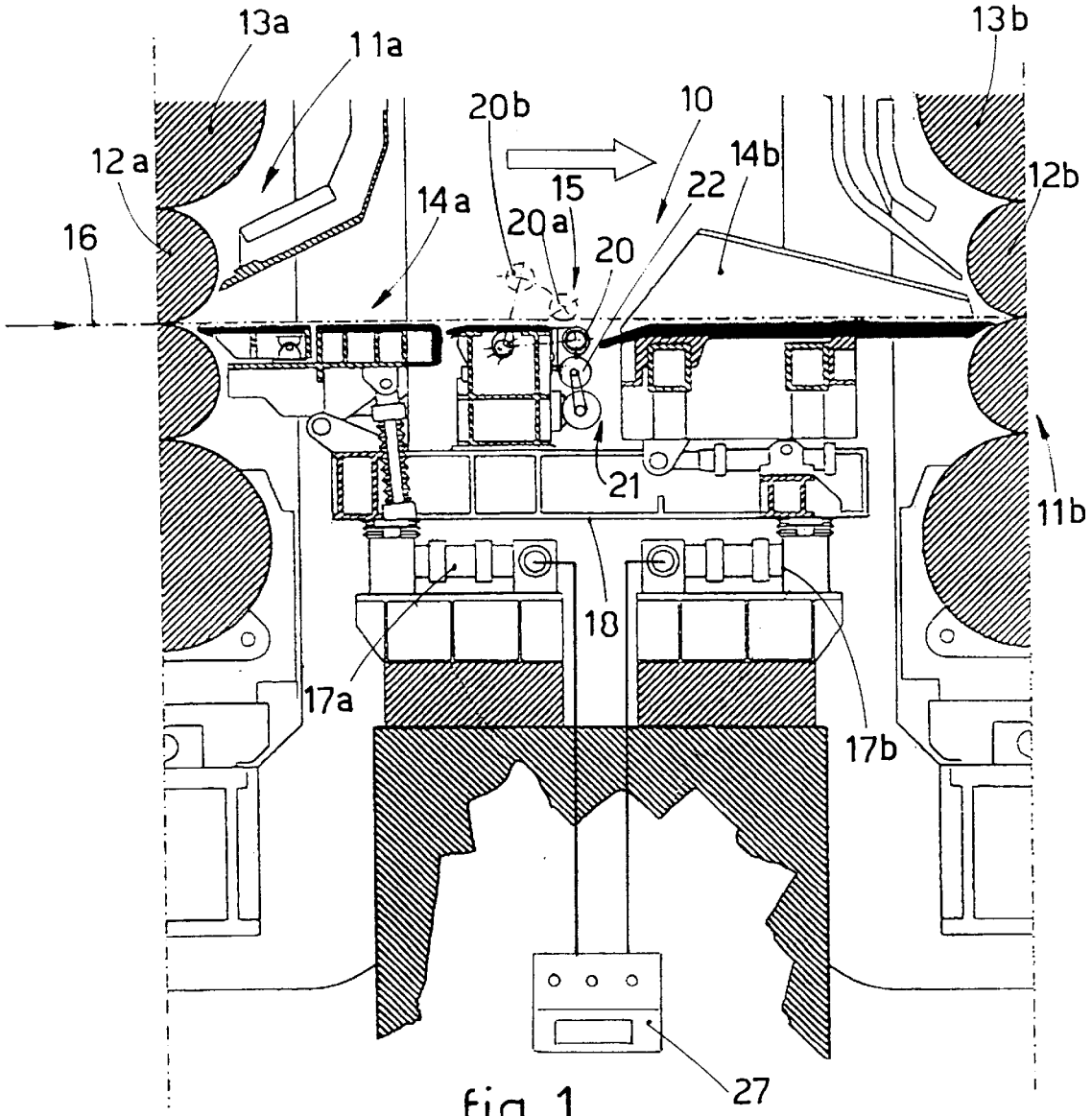
FIG. 1 is a diagram of a partial section of the inter-stand device according to the invention.
Figure 2:
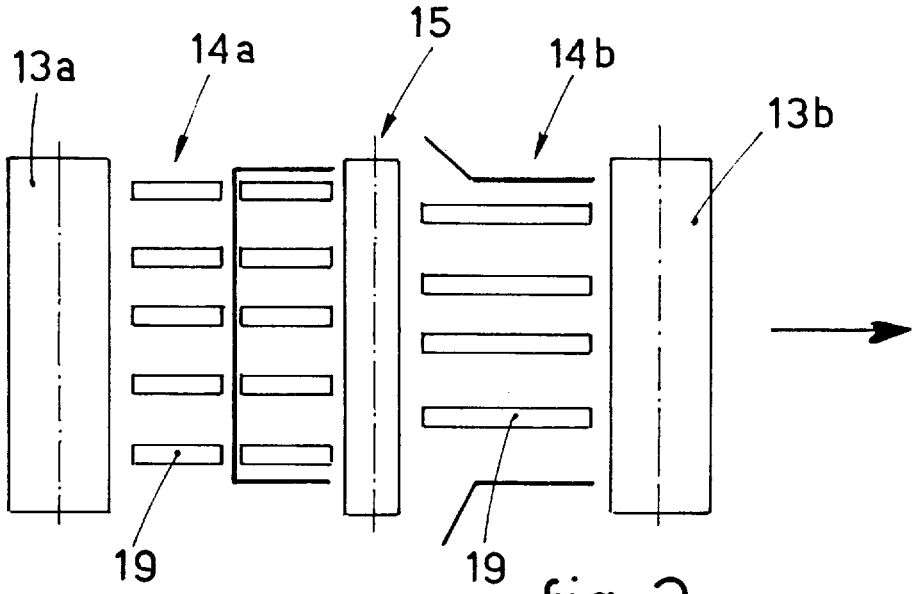
FIG. 2 shows in diagram form the view from above of the inter-stand device in FIG. 1.

The inter-stand device 10 shown in FIG. 1 is placed in a finishing train between a four-high rolling stand 11*a* arranged upstream with working rolls 12*a* and back-up rolls 13*a*, and a four-high rolling mill stand 11*b* arranged downstream with working rolls 12*b* and back-up rolls 13*b*.

The inter-stand device 10 has a first guide 14*a* arranged at the outlet of the upstream stand 11*a*, a looper unit 15 and a second guide 14*b* arranged at the inlet of the downstream rolling stand 11*b*.

In this case, the inter-stand device 10 comprises a system to align the inter-stand guides 14*a* and 14*b* to the pass-line 16 of the upstream stand 11*a* with the downstream stand 11*b*.

The alignment is achieved by means of two independent controls, in this case two jack screws, respectively 17*a* and 17*b*, hydraulic or electromechanical.

The jack screws 17*a* and 17*b* act on the common frame 18 of the guides 14*a* and 14*b* and of the looper unit 15 and allow these guides 14*a* and 14*b* to be aligned to the wire of the lower working rolls 12*a* and 12*b* of the upstream stand 11*a* and the downstream stand 11*b*.

In particular, according to the invention, the ideal pass-line 16 is calculated according to the real configuration of the stand, for example the values of the thicknesses and the diameters of the working rolls 12*a*, 12*b* and the back-up rolls 13*a*, 13*b*; the jack screws 17*a* and 17*b* are used to align the guides 14*a* and 14*b* to the ideal pass-line 16.

The jack screws 17*a* and 17*b* are connected to a control unit 27 which calculates the position of the ideal pass-line 16 according to the known values, and controls the jack screws 17*a* and 17*b* in order to obtain the desired activation of the guides 14*a* and 14*b* and of the looper unit 15.

The carrying surfaces of the guides 14*a* and 14*b* are composed of strips 19 which are distanced from each other and made of an anti-friction material.

Figure 3:
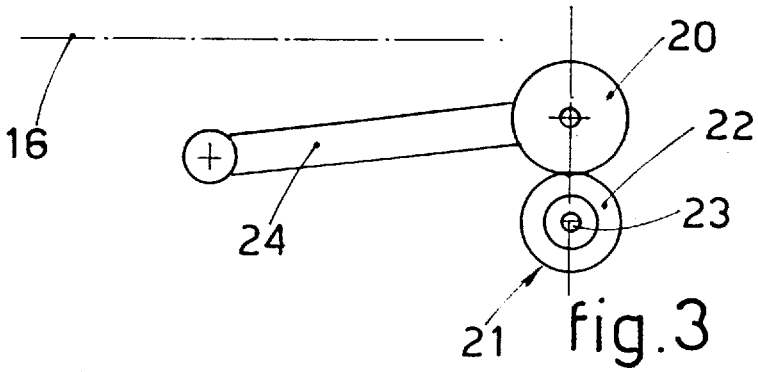
FIG. 3 shows the looper unit of the inter-stand device in FIG. 1.

According to the invention, the looper roller 20 is associated with drive means 21, either inner, outer or far from the looper 20, which make it rotate, when it is in the lowered position as shown in FIG. 3 and before the strip enters, below the pass-line 16, at a tangential speed at least equal to that of the strip in transit.

According to a variant of the invention, the tangential speed is advantageously equal to a value between 5% and 20% more than the transit speed of the strip.

In the case shown in FIG. 3, the looper roller 20 cooperates at the lower end with a back-up roller 22 associated with drive means 23.

In the embodiment shown in FIG. 1, there is a back-up roller 22 connected, by means of transmission means, with a driver.

The reference number 24 indicates the drive arm which causes the looper roller 20 to move from the lowered position to the desired high position. This may be the position where the strip enters the device in cooperation with the pass-line 16, or one of the working positions gripping the strip as it passes through, according to the size of the loop to be generated. These positions are those indicated by a dotted line 20*a* and 20*b* in FIG. 1.

The arm 24 is connected to a drive system, such as a linear motor, a hydraulic jack screw, or other type of drive system.

Figure 4:
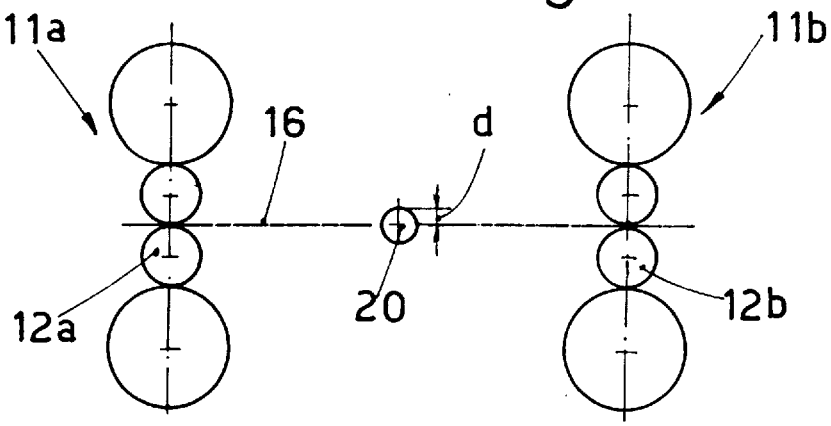
FIG. 4 shows a plan of the functioning of the inter-stand device in FIG. 1

According to one embodiment of the invention, before the strip enters, the looper roller 20 is put in rotation and taken from the lowered position to a position (FIG. 4) where it is slightly above the pass-line 16, to a value "d" of a few millimeters, in order to help the strip to advance by means of tangential thrusts.

When the strip has entered, the looper roller 20 is displaced or held in a desired, variable position so as to control the loop of the strip.

Figure 5:
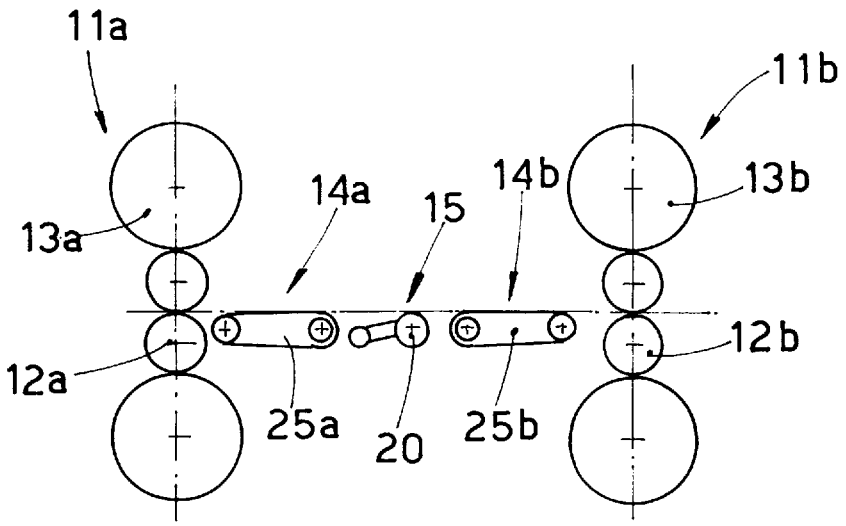
FIG. 5 shows a variant of FIG. 4.

According to the variant shown in FIG. 5, to further reduce the friction between the strip in transit and the interstand guides, the guides 14*a* and 14*b* are composed of driven transporter belts, respectively 25*a* and 25*b*, which accompany the strip from the upstream stand 11*a* to the downstream stand 11*b* thus avoiding in particular those problems which derive when the strip enters the device.

Figure 6:
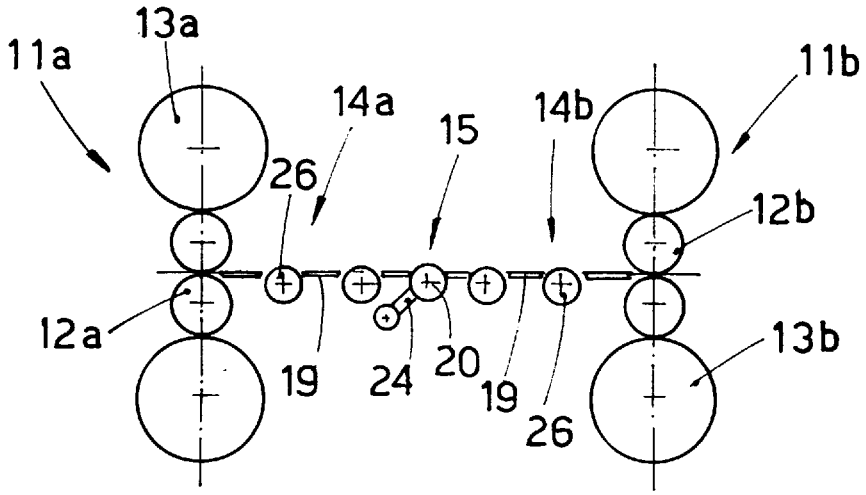
FIG. 6 shows another variant of FIG. 4.

According to the other variant shown in FIG. 6, the guides 14*a* and 14*b* are composed of strips 19 set at a distance from each other, between which there are driven rollers 26 which protrude above the carrying surface defined by the strips 19 and which also have the function of accompanying the strip tangentially on its movement between the stands.

We claim:

1. Method to guide strip between stands in a rolling mill finishing train to roll thin strips of a final thickness in the order of 1.2 mm and less, comprising feeding the strip through an inter-stand device including at least a guide device arranged at the outlet of the upstream stand, a looper unit comprising at least a looper roller and a guide device arranged at the inlet of the downstream stand, providing the looper roller in a lowered position before a leading end of the strip enters the inter-stand device and raising the looper roller to one of a plurality of raised positions, during the transit of the strip, to form a loop, and bringing the looper roller, at least when it is in the lowered position and before the strip enters, into rotation at a tangential speed at least equal to the speed at which the strip advances between the stands.

2. Method as in claim 1, in which the looper roller, at least in the lowered position before the strip enters, is made to rotate at a tangential speed greater than the speed at which the strip is fed by from 5% to 20%.

3. Method as in claim 1, in that the looper roller, in its raised position in contact with the strip is an idler roller.

4. Method as in claim 1, in which the looper roller, in its raised position in contact with the strip, is maintained in rotation at the same speed as the strip.

5. Method as in claim 1, in which the looper roller, in its raised position in contact with the strip, is maintained at a tangential speed slightly greater than that of the strip by a value of between 5% and 20%.

6. Method as in claim 1, further comprising aligning the guides by calculating an ideal pass-line from the configuration of the upstream and downstream stands, and correlating activation of independent positioning actuators, respectively for the upstream guide and for the downstream guide according to the ideal pass-line.

7. Method as in claim 1 in which the looper roller, before the strip enters, is positioned where it is slightly above the ideal pass-line by a value ("d").

8. Device in a rolling mill finishing train for rolling thin strips of a final thickness in the order of 1.2 mm or less, comprising at least a guide device arranged at the outlet of an upstream stand, a looper unit comprising at least a looper roller, a guide device arranged at the inlet of a downstream stand, the looper roller having at least a lowered position before the leading end of the strip enters and a plurality of raised positions, during the transit of the strip, to form a loop, and a motorised drive associated with the looper roller at least when the looper roller is in the lowered position, the motorised drive being structured so as to bring the looper roller into rotation, before the strip enters, at a tangential speed at least equal to the speed at which the strip is fed between the stands.

9. Device as in claim 8, in which the motorised drive is provided on the looper roller.

10. Device as in claim 8, in which the motorised drive is arranged spaced from the looper roller.

11. Device as in claim 8, in which the looper roller has a lowered position, a position at which the strip enters located at a value ("d") above an ideal pass-line and a plurality of working positions functionally correlated to the flow of material passing through the upstream stand and the downstream stand.

12. Device as in claim 8, in which at least one of the guide device provided at the outlet of the upstream stand and the guide device provided at the inlet of the downstream stand comprises strips set at a distance from each other made of anti-friction materials.

13. Device as in claim 8, in which at least one of the guide device provided at the outlet of the upstream stand and the guide device provided at the inlet of the downstream stand comprises driven transporter belts.

14. Device as in claim 8 inclusive, in which the guide devices are associated with respective independent positioning actuators controlled by a control unit which calculates an ideal pass-line according to the configuration of the stands upstream and downstream and which activates the positioning actuators according to this calculation so as to maintain the alignment of the strip with the ideal pass-line.

15. Device as in claim 12, in which at least one of the guide device provided at the outlet of the upstream stand and the guide device provided at the inlet of the downstream stand comprises driven rollers disposed between the strips and protruding above a pass-line defined by the strips.

* * * * *